United States Patent [19]

Sampson

[11] Patent Number: 4,789,082

[45] Date of Patent: Dec. 6, 1988

[54] CONTAINER DISCHARGE CONTROL

[76] Inventor: Renick F. Sampson, 5471 E. Hill St., Long Beach, Calif. 90815

[21] Appl. No.: 944,954

[22] Filed: Dec. 22, 1986

[51] Int. Cl.[4] ..... B67B 7/00; B65D 37/00

[52] U.S. Cl. ..... 222/1; 222/153; 222/206; 222/213; 222/215; 222/491; 222/541; 222/543; 141/1; 215/232; 215/306

[58] Field of Search ..... 222/1, 206, 212, 213, 222/215, 209, 490, 494, 153, 543, 541, 545, 556, 542, 569, 491; 220/89 A, 375; 215/232, 250, 306, 325; 137/68.1; 141/1

[56] References Cited

U.S. PATENT DOCUMENTS

| | | | |
|---|---|---|---|
| 1,082,696 | 12/1913 | Hicks | 215/232 |
| 1,419,829 | 6/1922 | Dowd | 222/491 |
| 2,107,226 | 2/1938 | Weston | 222/494 |
| 2,507,248 | 5/1950 | DeSwart | 222/490 X |
| 3,029,987 | 4/1962 | Gronemeyer | 222/569 X |
| 3,118,573 | 1/1964 | Johnson | 222/212 |
| 3,172,575 | 3/1965 | Vosburg | 222/185 |
| 3,324,906 | 6/1967 | Chu | 141/114 |
| 3,655,084 | 4/1972 | Willhaus et al. | 215/37 R |
| 4,131,211 | 12/1978 | Corbic | 215/2 |
| 4,269,330 | 5/1981 | Johnson | 222/494 X |
| 4,274,455 | 6/1981 | Simons | 141/1 |
| 4,513,883 | 4/1985 | Melzi et al. | 222/541 X |
| 4,696,328 | 9/1987 | Rhodes, Jr. | 222/541 X |

*Primary Examiner*—Joseph J. Rolla
*Assistant Examiner*—Gregory L. Huson
*Attorney, Agent, or Firm*—William W. Haefliger

[57] ABSTRACT

A device for controllably retaining liquid in and releasing liquid from a squeeze deflectable hollow container having a tubular neck defining a rim, about a mouth defined by the neck, incorporates a seal strip bonded to the rim about the mouth to extend over the mouth and block discharge of liquid from the container via the mouth. The strip is characterized as releasing from the rim in response to manual squeezing of the bottle and its liquid contents when the bottle is inverted, causing the contents to increasingly press against the strip; and a holder tab is carried by the strip and attached to the neck so as to retain the strip to the neck after it releases from the rim.

18 Claims, 1 Drawing Sheet

FIG. 2.
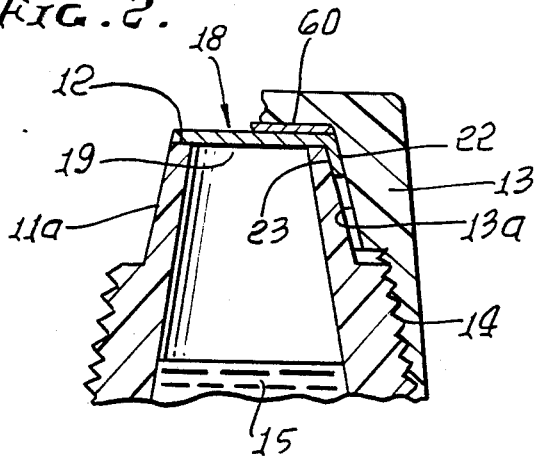
FIG. 1.
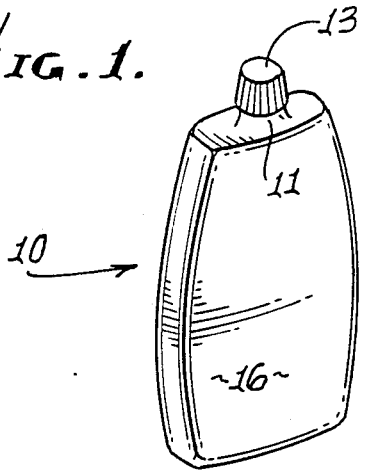
FIG. 3.
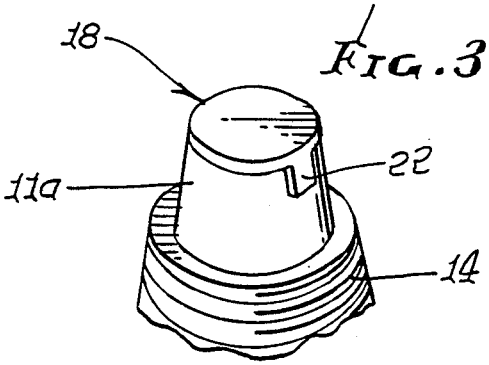
FIG. 4a.
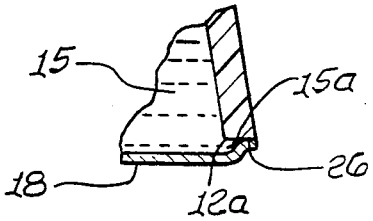
FIG. 4.
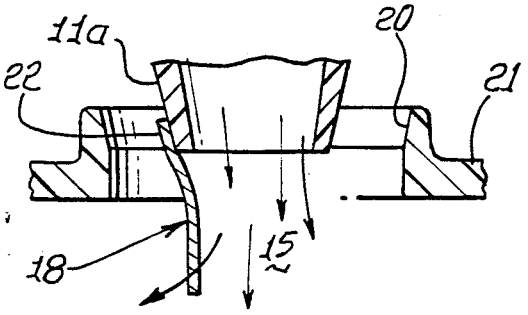
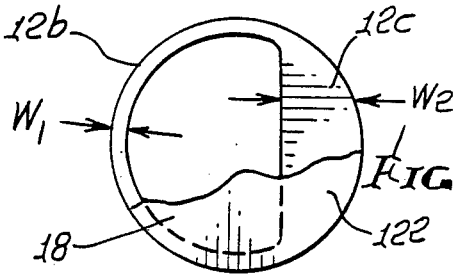
FIG. 5.
FIG. 6.
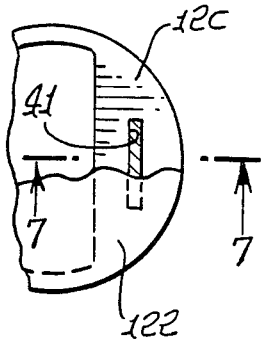
FIG. 7.
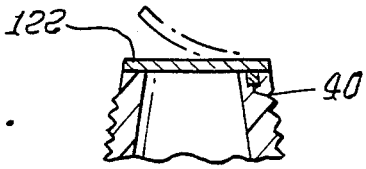

CONTAINER DISCHARGE CONTROL

BACKGROUND OF THE INVENTION

This invention relates generally to sealing of containers, and more particularly to controllable release of fluid or liquid from containers after the container have been inverted.

At the present time, containers, such as plastic bottles for motor oil, are opened prior to pouring of liquid from the container. As the container is inverted for pouring into a receptacle, as via an inlet to the latter, the liquid tends to easily spill from the container prior to the time that the container neck can be aligned with the inlet. There is need for means to prevent such spilling, and for means to easily remove the seal, without risk of seal loss into the receptacle.

SUMMARY OF THE INVENTION

It is a major object of the invention to provide method and means providing solutions to the above problems and difficulties. To this end, a device is provided for controllably retaining liquid in and releasing liquid from a squeeze deflectable hollow container having a tubular neck defining a rim, about a neck mouth, comprising (a) a seal strip bonded to said rim about said mouth to extend over the mouth and block discharge of liquid from the container via said mouth, the strip characterized as releasing from the rim in response to manual squeezing of the bottle and its liquid contents when the bottle is inverted, causing such contents increasingly to press against the strip, (b) and a holder tab carried by the strip and attached to the neck so as to retain the strip to the neck after it releases from the rim.

Typically, the strip has the form of a disc, or wafer and the tab may be integral with the strip to extend downwardly from the plane of the strip and adjacent said neck outer side.

In other advantageous forms of the invention, the rim may have first and second sections, the second section having varying width along its length and the first section being C-shaped and having substantially uniform width along its length, such uniform width being less than the width of the second section along the major length of the second section, the tab bonded to the second section; the strip may be bonded to only the outer portion of the rim, so that liquid may initially penetrate between the inner portion of the rim and the strip as the container is inverted; and the strip may be positively anchored to the neck via a recess sunk in said second section of the rim, the strip having an anchor in said recess.

These and other objects and advantages of the invention, as well as the details of an illustrative embodiment will be more fully understood from the following specification and drawings, in which:

DRAWING DESCRIPTION

FIG. 1 is a perspective view of a container incorporating the invention;

FIG. 2 is an enlarged elevation, in section, showing one embodiment of the invention;

FIG. 3 is an enlarged perspective view showing the FIG. 2 embodiment;

FIG. 4 is a view like FIG. 2, but showing the container inverted to discharge contained liquid;

FIG. 4*a* is a section showing a modification;

FIG. 5 is a top plan view showing a modification of the invention;

FIG. 6 is a view like FIG. 5 showing a further modification; and

FIG. 7 is a section on lines 7—7 of FIG. 6.

DETAILED DESCRIPTION

In FIGS. 1–4, a container 10 is hollow and has a tubular neck 11 defining a top annular rim 12. A cap 13 fits over the neck, and is releasably attached to the neck, as by threading at 14. Other means of attachment may be provided. Liquid 15 is received in the container and is to be controllably discharged when the container is inverted. The container may typically have opposite side walls 16 to be manually squeezed toward one another to develop pressure on and in the liquid 15. The container and cap may consist of molded synthetic resin, i.e. plastic material.

In accordance with the invention, a seal strip is adhered or bonded to rim 12 about the mouth 19, to extend over and close the mouth, blocking discharge of liquid as when the container is upright or inverted, and the cap is removed. The strip 18 is characterized as releasing from that rim in response to manual squeezing of the bottle and its liquid contents when the bottle is inverted, causing said contents to increasingly press against the strip. See in this regard liquid 15 discharging from the container neck and mouth after having forced the strip 18 loose from the rim 12. This occurs in response to squeezing of the container as described above to develop sufficient pressure in the liquid to force loose the strip from the rim, with the container inverted. Thus, hydro-static pressure $P_1$ of the liquid itself on the strip, plus the added pressure $P_2$ developed in the liquid by squeezing the container, forces loose the strip. This may be accomplished after the neck and mouth are inserted into the neck 20 of a receptacle 21, without prior concern for unwanted spilling of liquid from the container as it is inverted, without the bonded strip 18 being present. See FIG. 4.

Further, in accordance with the invention, a holder tab 22 is carried by the strip 18 and is attached to the neck 11, so as to retain the strip to the neck after it releases from the rim, as in FIG. 4. This prevents unwanted loss of the strip 18 into the receptacle 21. As shown, the tab may be integral with the strip 18, and extends downwardly from the disc-like plane of the strip, adjacent the neck outer side. It is shown as bonded at 23 to annular extent 11*a* of the neck of reduced outer diameter relative to thread 14. Suitable known adhesive or adhesives may be employed to releasably bond the strip to the rim, and to bond the tab to the wall of the neck. Examples of such adhesives are: silicon based adhesive, one example being Silicone Auto Seal, a product of General Electric Company. Other adhesives are usable. The strip itself may consist of plastic, fabric, or metal foil (aluminum for example). FIG. 4*a* shows a modification wherein the strip 18 is bonded at 26 to only the outer annular portion of the rim 12, so that liquid may initially penetrate at 15*a* between the inner portion 12*a* of the rim and the strip, as the container is inverted. This assists the pressure release of the strip from the rim.

In the modification shown in FIG. 5, the rim 12 has first and second sections 12*b* and 12*c*. Section 12*c* has varying width $W_2$ along its length; and section 12*b* is C-shaped and has substantially uniform width $W_1$, along its length. In this regard $W_2$ is substantially greater than $W_1$ along the major length of section 12*c*, the latter having sector shape. The modified tab 122 is bonded to rim section 12*c*, and remains bonded to at least a portion of same during release of the tab from section 12*b* when the container is inverted and pressure is applied. FIGS. 6 and 7 show positive retention of the tab 122 to the section 12*c*, as via an integral anchor boss 40 on the strip 18, and received in a recess 41 sunk in the section 12*c*, as shown. The anchor may be bonded to the walls of that recess.

In FIG. 2, the cap 13 has an interior seal at 60 serving two functions: first, it engages the strip 18 prior to discharge of fluid from the container so that pressure applied to walls 16 will not cause lift-off of strip 18; and secondly, it ultimately engages the rim 12 to seal the container, after strip 18 is pulled completely off the neck following discharge of some of the liquid from the container. Note also that the inner tapered wall 13*a* of the cap engages and presses the tab 22 against the neck 11*a* further assuring attachment of the tab to the neck, when the cap is tightly screwed on the neck.

Within the scope of the invention is the use of an aluminum or other metal sealing strip having adhesive on one side thereof, which is capable of firm sealing to a plastic bottle. A silicone or other release agent can then be applied to the rim, but not the neck side wall. Therefore, when the sealing strip tab is applied to the neck, it firmly attaches the tab to the neck; however, the release agent acts to allow less firm attachment of the strip adhered to the rim, whereby the strip will detach from the rim when the bottle is inverted and squeezed but the tab will not detach from the neck.

I claim:

1. A device for controllably retaining liquid in and releasing liquid from a squeeze deflectable hollow container having a tubular neck defining a rim, about a mouth defined by the neck, comprising (a) a non-frangible seal strip releasably bonded to said rim about said mouth to extend over the mouth and block discharge of liquid from the container via said mouth, said strip characterized as releasing from said rim in response to internal pressurization of said container by manually squeezing the container and its liquid contents when the container is inverted, causing said contents to increasingly pressure against the strip to sever its bond from the rim, (b) and a holder tab carried by the strip and attached to the neck so as to retain the strip to the neck after it releases from the rim.

2. The device of claim 1 wherein said strip is in the form of a disc, and said tab is integral with the strip to extend downwardly from a plane defined by the strip and adjacent said neck outer side.

3. The device of claim 1 including said container, which consists of molded plastic, containing said liquid, the container having a cap thread connected to said neck, the neck having a portion to which the tab is bonded, said portion having a reduced radial dimension relative to said threading.

4. The device of claim 1 wherein said strip consists of one of the following:

(a) fabric
(b) metal foil
(c) plastic

5. The combination that includes the device of claim 1, the container associated therewith, and a cap on the container extending over said strip and said tab, and an interior seal on the cap engaging said strip.

6. The combination of claim 1 wherein the strip is bonded to only the outer portion of the rim, so that liquid may initially penetrate between the inner portion of the rim and the strip as the container is inverted.

7. The device of claim 1 wherein the strip has a first plastic sealing adhesive on one side thereof facing the rim and adapted to rigidly adhere to the container material, and also including a second adhesive applied between the rim and said first adhesive to decrease the adherence of the strip to the rim, while allowing rigid adherence of the tab to the neck.

8. The combination that includes the device of claim 1, the container associated therewith and having an outer side wall, and a cap on the container and having an inner wall engaging the tab and urging the tab against the container outer side wall.

9. The device of claim 1 wherein said rim has first and second sections, the second section having varying width along its length and the first section being C-shaped and having substantially uniform width along its length, said uniform width being less than the width of the second section along the major length of the second section, the tab bonded to said second section.

10. The device of claim 9 wherein said second section has sector shape.

11. The combination of claim 9 wherein the strip is anchored to the neck via a recess sunk in said second section of the rim, the strip having an anchor in said recess.

12. The method of controllably retaining liquid in and releasing liquid from a squeeze deflectable hollow container having a tubular neck defining a rim, about a neck mouth, and employing a non-frangible seal strip and a holder tab carried by said strip, that includes:

(a) bonding the seal strip to said rim said about mouth to extend over the mouth and block discharge of fluid from the container via said mouth, said strip bond characterized as releasing from said rim in response to internal pressurization of said container by manually squeezing the container and its liquid contents when the container is inverted, causing said contents to increasingly press against the strip to sever its bond with the rim, (b) and also bonding said tab to said neck so as to retain the strip to the neck after it releases from the rim.

13. The method of claim 12 that also includes filling liquid into the container, and attaching a sealing cap to the neck so that the cap engages only the top of the strip, in spaced relative to the tab.

14. The method of claim 12 including said (b) step including bonding the tab to the outer side of the container neck, below the level of said rim.

15. The method of claim 12 wherein said strip consists of one of the following:

(a) fabric
(b) metal foil
(c) plastic

16. The method of claim 10 including filling liquid in the form of engine oil into said container.

17. The method of claim 12 wherein said rim is provided in the form of first and second sections, the second section having varying width along its length and the first section being C-shaped and having substantially uniform width along its length, said uniform width being less than the width of the second section along the major length of the second section, the tab bonded to said second section.

18. The method of claim 17 wherein said container is molded to form said second section to have sector shape.

* * * * *